US005186335A

United States Patent [19]

Fahey et al.

[11] Patent Number: 5,186,335

[45] Date of Patent: Feb. 16, 1993

[54] ADJUSTMENT DOCUMENT STORAGE DEVICE FOR A DOCUMENT SORTER

[75] Inventors: Laura B. Fahey; Michael D. Garten; David G. Lyke, all of Charlotte, N.C.

[73] Assignee: International Business Machines Corporation, Armonk, N.Y.

[21] Appl. No.: 439,071

[22] Filed: Nov. 20, 1989

[51] Int. Cl.[5] ..... B07C 7/04

[52] U.S. Cl. ..... 209/552; 211/10; 211/168; 211/170; 209/583; 209/933

[58] Field of Search ..... 209/900, 702, 583, 584, 209/933, 546, 547, 548, 534, 552, 569; 211/59.2, 168, 126, 50, 98, 170, 10; 312/148

[56] References Cited

U.S. PATENT DOCUMENTS

| | | | |
|---|---|---|---|
| D. 261,668 | 11/1981 | Ogg et al. | D19/92 |
| D. 267,594 | 1/1983 | Ogg et al. | D34/22 |
| D. 273,546 | 4/1984 | Ogg et al. | D6/181 |
| 2,570,636 | 10/1951 | Bolling | 211/10 X |
| 3,067,874 | 12/1962 | Rigg et al. | 209/548 |
| 4,991,914 | 2/1991 | Kerstein | 211/10 X |

FOREIGN PATENT DOCUMENTS

| | | | |
|---|---|---|---|
| 851969 | 1/1940 | France | 211/50 |
| 1058768 | 3/1954 | France | 211/50 |
| 1450890 | 1/1989 | U.S.S.R. | 209/702 |
| 675381 | 7/1952 | United Kingdom | 211/10 |

*Primary Examiner*—Donald T. Hajec
*Attorney, Agent, or Firm*—Kenneth A. Seaman

[57] ABSTRACT

An adjustable storage rack for a document processor in which a plurality of document receiving slots are each associated and aligned with one of the sorter pockets when the rack is secured to the document processor frame. Advantageously, the securing occurs through a pivoting hinge, allowing the rack to be supported in one of a plurality of defined positions.

2 Claims, 2 Drawing Sheets

ADJUSTMENT DOCUMENT STORAGE DEVICE FOR A DOCUMENT SORTER

BACKGROUND OF THE INVENTION

1. Field of the Invention

The present invention relates to a method and apparatus for processing documents wherein a variable-position or adjustable document storage device is secured to a document sorter with its storage trays of the device adjacent to and below the associated sorter pockets.

2. Prior Art

In the processing of checks and other documents, it is frequently desirable to have a plurality of bins or pockets, each of which is associated with different characteristics of the documents. A document sorter (or document processor) reads indicia on the document to determine in which bin or pocket to place that document. For example, a bank sorting the checks that it has received one day may be interested in sorting the checks that are drawn on another in-town bank into a second pocket out-of-town checks into a third pocket and checks on which the indicia cannot be properly read into another pocket. As these pockets fill up at various rates, an operator typically moves the checks from the pockets into an associated tray for temporary storage. Ideally, these storage trays should be aligned with the associated sorter pocket to make the operators job both easier and minimize the chance of mistakenly putting checks into the wrong storage tray.

There is an advantage to positioning storage trays both below the check processor and at an acute angle with respect to the vertical plane. By moving the documents downward (rather than up), the operator inherently has the advantage of gravity and is less likely to drop the checks. By placing them at an acute or inclined angle with respect to the vertical, the operator can more easily and conveniently see the documents being placed into the tray and can perform the necessary pocket and tray association. An inclined angle with respect to the horizontal urges the documents into a more uniformly stacked arrangement (a neater stack).

IBM sells its IBM Model 3890 document processor which includes a sorter and has a plurality of sorter pockets with storage bins located above the individual pockets. As long as the vertical height of the processor is low enough to allow convenient access to this overhead space, such storage provides an acceptable approach to document processing. However, some sorters stand taller than others. For example, the IBM 3892 document processor positions the top surface of its pockets at approximately 60 inches above the floor level before any storage trays are mounted on top of it. This height effectively precludes the placement of additional storage trays on top of the processor because of the relative difficulty a short operator would have in reaching such trays and because of work place safety considerations which dictate objects which might fall should not be positioned above workers' heads.

Some have suggested placing storage trays in front of the document processor and on a separate cart. For example, design Pat. No. Des. 267,594 to Elmer Ogg and assigned to System Unlimited, Inc. shows one such arrangement. However, a freely moveable the cart extends some substantial distance in front of the sorter. When the cart and storage trays are in this position, an operator may not be able to reach conveniently the feed path to clear a jam in the check feeding area or to reach even the checks in the pockets. This inability of the operator to conveniently reach important operational elements (namely the check feed path and pockets) is a limitation in the prior art system.

This arrangement as shown in the Ogg patent is also inherently fixed in design and does not accommodate different sized operators. That is, a tall operator may find that the document tray is too low or a short operator may find that the document tray is too high.

The moveable cart of this design does not maintain an inherently fixed alignment between the storage trays and the sorter pockets—i.e., the cart, being completely separate from the sorter, can be moved independently of the sorter. That is, the cart and its tray could be moved left or right and the storage trays could appear to be aligned with a sorter pocket to which the trays are, in fact, not associated. This could lead to improper unloading of the sorter pockets into the wrong storage tray. This misalignment and resulting improper unloading could result when the document cart has been removed to clear a jam and the tray is moved back into the wrong position, for example.

Design Pat. No. Des. 273,546 shows another separate storage rack for supporting checks. It is neither fixed to a sorter nor shows a relationship to being in a sorter. Design Pat. No. Des. 261,668 shows a tray usable in the previously mentioned design patents and in connection with the present invention.

Accordingly, the prior art sorters have inherent disadvantages and limitations.

SUMMARY OF THE INVENTION

The present invention overcomes the limitations and the disadvantages of the prior art sorters by providing storage compartments which are inherently and fixedly laterally aligned with associated sorter pockets. The storage compartments are positioned below the associated sorter pockets in a vertically aligned position and in a rotatably adjustable position so that the variations in operator comfort and access needs can be accommodated. Further, access to the sorter and the feed path are facilitated by the adjustable storage tray arrangement. That is, the storage tray can be lowered to a retracted position allowing full access to the feed path as necessary, and then moved back into an operating position after the jam has been cleared.

The present invention advantageously maintains a single storage tray aligned with each single pocket while allowing the entire bank of storage trays to be moved either up or down.

The foregoing and other objects and advantages will be apparent to those skilled in the art in view of the following detailed description of the best mode of carrying out this invention taken with the appended claims and the accompanying drawings.

BEST MODE FOR CARRYING OUT THE INVENTION

Figure 1:
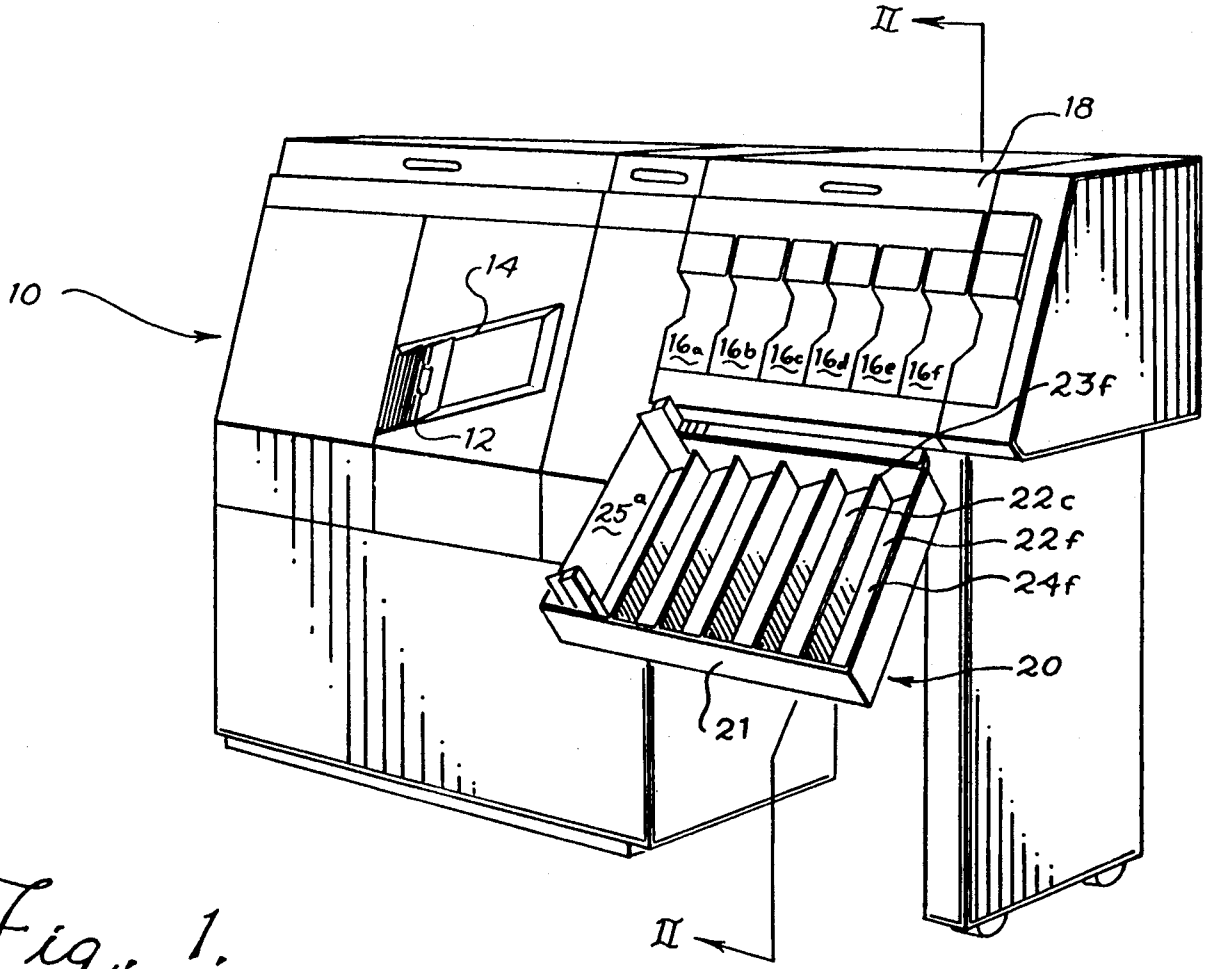
FIG. 1 is a perspective view of a document sorter including the present invention.

FIG. 1 illustrates a document sorter 10 of the present invention. This sorter 10 has similarities to the document sorters sold commercially as the IBM Model 3892 Document Processor, and the reader may wish to refer to the Guide to Operations for such machine for further details, which document is herein incorporated by reference. Generally speaking, the sorter 10 includes transport mechanisms for moving checks 12 from an input bin 14, reading the checks in a manner that is well known in the art (by apparatus not shown), and processing the information from such reading (by apparatus also not shown) to select one of a plurality of sorter pockets 16*a*, 16*b*, 16*c*, 16*d*, 16*e*, 16*f* . . . Above these pockets 16 is a feed path through which the documents are moved to the proper sorter pocket. This feed path (not specifically shown) is located, in this representative sorter, above the sorter pockets and is covered by a removable cover 18. The removable cover 18 may be opened to expose the feed path in the event of a jam or other maintenance requirement to allow an operator or a maintenance person access to the mechanism to either remove documents or to perform maintenance.

Suspended from the document sorter 10 and mounted at an acute angle with respect to the vertical plane is a storage tray rack 20. This storage tray rack 20 includes a generally rectangular frame 21, which in the preferred embodiment, may be molded from plastic or formed metal as desired, and depending on the loads to be carried. The storage tray rack 20 includes a plurality of slots 22*e*, 22*f*, each of which is generally positioned below and aligned with the associated sorter pocket 16*e*, 16*f*, for example. That is, the slot 22*e* is positioned directly below the sorter pocket 16*e* so that as the sorter pocket 16*e* fills up with sorted checks, an operator can unload the pocket 16*e* into the associated slot 22*e*. Similarly the slot 22*f* in the tray rack 20 is associated with the sorter pocket 16*f*.

Each of the slots is defined by a generally vertical wall 23*f* and a floor 24*f* which, in the preferred embodiment is slightly inclined, tapering downward as one moves from right to left. A removable storage tray 25*a*, only one of which is shown in the present figure, may be positioned within each of these slots, or alternatively, each of these slots may be formed with walls high enough to provide a storage location for checks without requiring storage trays. The removable storage tray 25*a* may be as shown in Design Pat. No. Des. 261,668, which is incorporated herein by reference.

Figures 2, 3, 4:
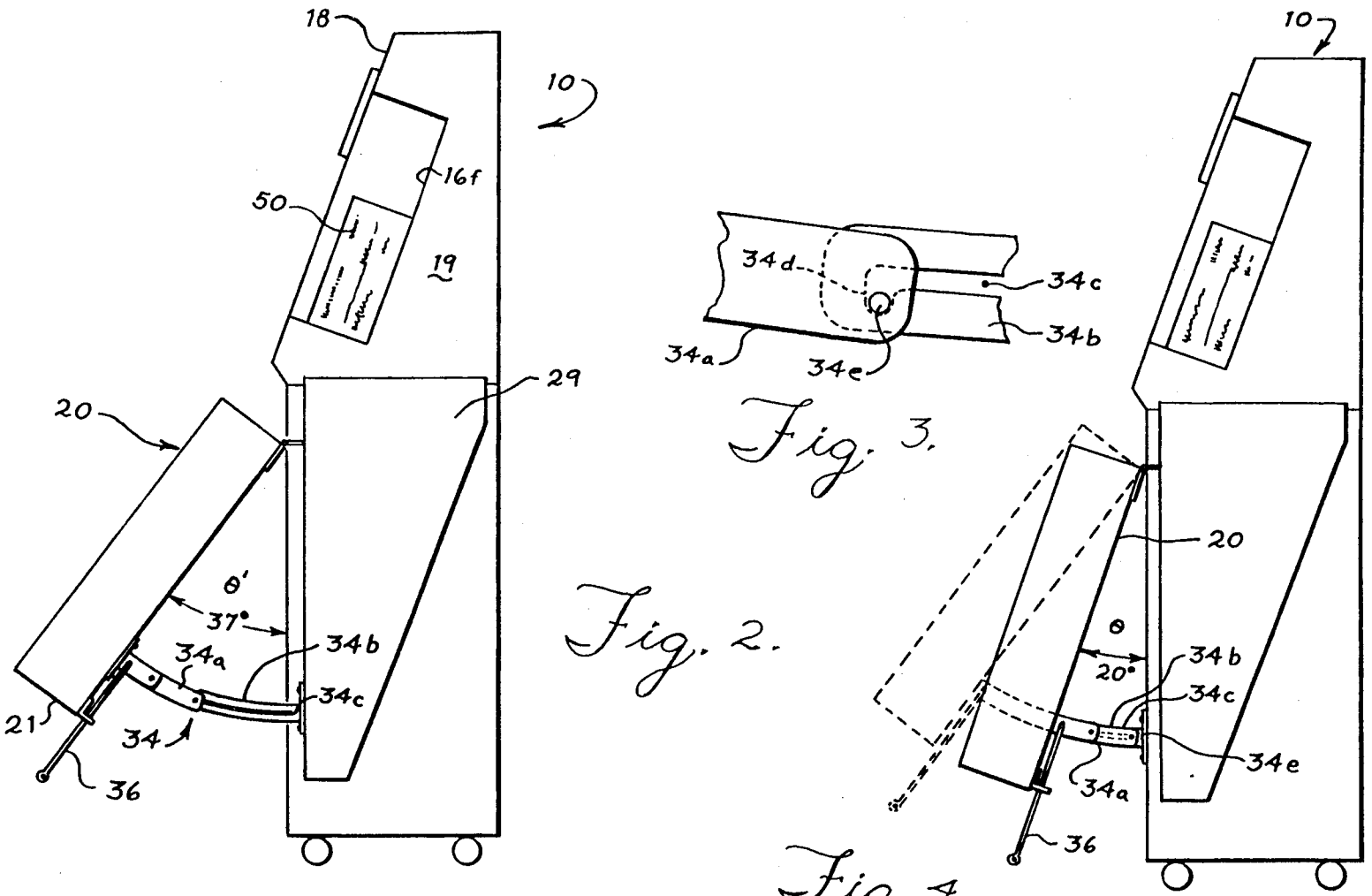
FIG. 2 is a cross-sectional view of the document sorter of FIG. 1 taken along the line II—II, looking in the direction of the arrows.
FIG. 3 is an enlargement of a portion of FIG. 2.
FIG. 4 is a view of the sorter of FIG. 2, but with the document storage tray rack in its alternate position.

FIG. 2 illustrates a cut-a-way view of the document sorter 10 of FIG. 1 looking in the direction of the arrows. A document 50 (the top document on a stack of documents) is shown in sorter pocket 16*f*. Frame 19 extends behind the pocket and supports the pockets and the cover 18. The tray rack 20 and its associated frame 21 are shown in the side view, mounted at a first angle $\theta'$ with respect to the frame 19 of the document processor 10 and a vertical perpendicular. While $\theta'$ is, in its preferred embodiment, approximately 37 degrees with respect to the vertical, this amount can be changed to fit the operator's comfort, i.e., allowing the tray to be high enough to be reached conveniently while allowing access to the sorter pockets 16*f* and the check feeding area below the cover 18. The tray rack 20 is secured to the frame via a hinge 28 and a bracket 29. Toward the lower portion of the tray rack 20, a stand-off from the bracket 29 is provided by assembly 34 consisting of a first member 34*a* and a second member 34*b* having a slot 34*c*. A handle 36 is secured to the first member 34*a* to rotate it.

The bracket 29 is made of a steel plate bolted (not shown) to the frame of the document sorter 10 and supports the tray rack 20.

As is shown in FIG. 3, an enlargement of portions of the first member 34*a* and the second member 34*b* illustrates the cooperation therebetween. The slot 34*c* in the second member 34*b* includes a "dog-leg" portion 34*d*. The first member 34*a* carries a projecting pin 34*e* which fits in the slot 34*b*, and is shown in the dog-leg portion 34*d* to secure the tray in its position farthest out and up as shown in FIG. 2.

By moving the handle 36 backward or in the direction of the arrow in FIG. 2, the tray rack 20 can be moved to its down or inward position as shown by solid lines in FIG. 4. Its position in FIG. 2 is shown by dotted lines for reference. Now the tray rack 20 makes an angle $\theta'$ which is approximately 20 degrees with respect to the vertical. The first member 34*a* substantially overlaps the second member 34*b* and the pin 34*e* is at the far rear end of the slot 34*c*. The handle 36 can also be used to lift the lower edge of the tray rack 20 from its down position of FIG. 4 to its raised, or outwardly extending position of FIG. 2. Of course, many modifications of the present invention may be made without departing from the spirit of this invention. For example, the tray could be mounted and movably secured in place by pistons allowing it to move or rotate in response to pressure toward the distal or free end. Multiple positions could be defined by varying slots or detents if desired for the tray rack. Also, some of the features of the present invention may be used without corresponding use of other features. For example, the removable check trays are desirable, but not essential, as is the inclined floor of the track rack which tips the checks (and trays, if used) at an angle. Thus, the foregoing description should be considered as merely illustrative of the principles of the present invention, and not in limitation thereof.

Having thus described the invention, what is claimed is:

1. A document sorting apparatus comprising:

a frame;

a plurality of sorter pockets carried on said frame;

means carried on said frame for moving a document along a feed path from an input hopper to a selected one of said sorter pockets depending on reading of indicia on said document; and a rack hingedly connected at one edge thereof to said frame and including a plurality of storage bins, each storage bin positioned adjacent to one of the sorter pockets, said hinged connection to said frame allowing the rack to move between a first position making a larger angle with respect to the frame and a second position making a second smaller angle with respect to said frame, with the second position allowing improved access to the feed path for the document.

2. A rack for attachment to a frame of a document sorting apparatus including a plurality of sorter pockets spaced horizontally along said frame, said rack including:

a plurality of horizontally spaced dividers forming a plurality of document receiving apertures, each of said apertures being associated with one of said plurality of said sorter pockets; and means for fixedly but adjustably connecting the rack to the frame of the document sorting apparatus whereby each of the apertures is fixedly aligned with one of the sorter pockets, wherein said means for adjustably connecting said rack to said frame includes a hinge, with said hinge allowing the rack to rotate between a first and second operating positions, where in each of the first and second operating positions an aligned relationship between the aperture and the associated sorter pocket is maintained.

* * * * *